US010138689B2

(12) United States Patent
Gordey et al.

(10) Patent No.: US 10,138,689 B2
(45) Date of Patent: Nov. 27, 2018

(54) TOOL AND METHOD FOR USE IN SUPPORTING A SUCKER ROD STRING IN AN OIL OR GAS WELL

(71) Applicant: 1904296 ALBERTA LTD., Calgary (CA)

(72) Inventors: Kenneth Nicholas Gordey, Estevan (CA); Leslie Joan Kohnen, Calgary (CA); Dennis Francis Ranks, Didsbury (CA); Jeffery Errol Dickie, Calgary (CA); William G. Groves, Coleman (CA)

(73) Assignee: 1904296 ALBERTA LTD., Calgary, Alberta (CA)

( * ) Notice: Subject to any disclaimer, the term of this patent is extended or adjusted under 35 U.S.C. 154(b) by 302 days.

(21) Appl. No.: 15/130,504

(22) Filed: Apr. 15, 2016

(65) Prior Publication Data

US 2016/0305200 A1 Oct. 20, 2016

Related U.S. Application Data

(60) Provisional application No. 62/148,091, filed on Apr. 15, 2015.

(51) Int. Cl.
*E21B 19/02* (2006.01)
*E21B 43/12* (2006.01)

(52) U.S. Cl.
CPC ..... *E21B 19/02* (2013.01); *E21B 43/127* (2013.01)

(58) Field of Classification Search
CPC ..... E21B 19/02
See application file for complete search history.

(56) References Cited

U.S. PATENT DOCUMENTS

| | | | |
|---|---|---|---|
| 2,067,700 | A | 1/1937 | Hunt et al. |
| 2,793,917 | A | 5/1957 | Ward |
| 4,060,249 | A | 11/1977 | Stowe et al. |
| 4,249,831 | A | 2/1981 | Sable et al. |
| 4,467,871 | A | 8/1984 | Rollwitz |

(Continued)

FOREIGN PATENT DOCUMENTS

| | | |
|---|---|---|
| CA | 1249219 | 1/1989 |
| CN | 2763476 Y | 3/2006 |

OTHER PUBLICATIONS

Alberta Energy Regulator, Directive 013: Suspension Requirements for Wells, Jul. 17, 2007.

(Continued)

*Primary Examiner* — Robert E Fuller
(74) *Attorney, Agent, or Firm* — Victor A. Cardona; Heslin Rothenberg Farley & Mesiti P.C.

(57) ABSTRACT

A tool for use in suspending operation of an oil or gas well driven by an artificial lift with a polished rod connected to a sucker rod in a tubing string includes a body having a lower narrow portion dimensioned to fit within the interior cavity of a tubing string inlet or an upper extension thereof; an upper wide diameter portion defining a substantially horizontal landing surface dimensioned to rest upon the top edge of the tubing string inlet or the upper extension thereof; one or more sucker rod-engaging structures; and one or more longitudinal slots extending through the lower narrow portion and the upper wide diameter portion to allow passage of fluid or gas through the tool when the tool is supported on the top edge of the tubing string inlet or the upper extension thereof.

19 Claims, 12 Drawing Sheets

(56) References Cited

U.S. PATENT DOCUMENTS

| | | | |
|---|---|---|---|
| 4,655,284 | A | 4/1987 | McIlvride |
| 5,137,083 | A | 8/1992 | Bump |
| 5,494,104 | A | 2/1996 | Sable, II |
| 5,549,158 | A | 8/1996 | Hart |
| 5,743,332 | A | 4/1998 | Lam et al. |
| 6,223,819 | B1 | 5/2001 | Heinonen |
| 6,595,278 | B1 | 7/2003 | Lam et al. |
| 8,141,633 | B2 | 3/2012 | Hampton et al. |
| 9,187,969 | B2 | 11/2015 | Harkins et al. |
| 2009/0065190 | A1 | 3/2009 | Smith |
| 2011/0198072 | A1 | 8/2011 | Cote et al. |
| 2012/0088588 | A1 | 4/2012 | Xin et al. |
| 2013/0213671 | A1 | 8/2013 | Reimert et al. |
| 2015/0099838 | A1 | 4/2015 | Baleno et al. |
| 2015/0107823 | A1 | 4/2015 | Gronning |
| 2015/0114670 | A1 | 4/2015 | Turner |
| 2015/0275610 | A1 | 10/2015 | Tan |

OTHER PUBLICATIONS

Alberta Energy Regulator, AER Bulletin 2014-19, Jul. 4, 2014.
International Search Report of PCT/CA2016/050432 dated Jun. 13, 2016.
Written Opinion of PCT/CA2016/050432 dated Jun. 13, 2016.

TOOL AND METHOD FOR USE IN SUPPORTING A SUCKER ROD STRING IN AN OIL OR GAS WELL

CROSS REFERENCE TO RELATED APPLICATIONS

This application claims priority from U.S. Provisional Application Ser. No. 62/148,091 filed Apr. 15, 2015, the entire disclosure of which is incorporated herein by reference in its entirety.

FIELD OF THE INVENTION

The invention relates to the field of oil and gas extraction and provides a tool and method for use in supporting a sucker rod assembly in an oil or gas well.

BACKGROUND OF THE INVENTION

Oil and gas production wells will vary in the extent of production over time and low commodity prices will often dictate that it is more cost effective to halt production and re-start production when commodity prices recover.

The process of closing and securing a well with the intention of restarting it at a later date is known in the art as "well suspension." This is done to protect the environment from any possible pollution. This process requires a significant amount of workover at the well. For a typical pumpjack-type well, the process for preparing the well for suspension will include removal of the polish rod, sucker rod string and pump, followed by pumping of anti-corrosive agents into the well before the wellhead is closed and secured. In addition, the removal of these components requires the use of a service rig operation and typically will take a crew of operators an entire day to complete the removal of the pumping equipment to install a wellhead to complete a well suspension. During reactivation, the process is repeated by installing the sucker rod assembly with a service rig operation. This process can be quite costly because once removed, the polish rod, sucker rod and pump typically require replacement at the time of restarting the well due to the probability of corrosion or damage.

In addition, the process of construction and disassembly of a sucker rod assembly during well servicing operations requires a service rig and is quite costly and time consuming because it is typically performed as a continuous task from start to finish requiring overtime.

The following list of US patents and published patent applications describes wellhead components, and sucker rods, as well as related tools and equipment: U.S. Pat. Nos. 2,793,917, 4,060,249, 4,249,831, 4,467,871, 4,655,284, 5,137,083, 5,494,104, 5,549,158, 5,743,332, 6,223,819, 6,595,278, 8,141,633, 9,187,969, 20110198072, 20120088588, 20130213671, 20150099838, 20150107823, 20150114670 and 20150275610. Each of these documents is incorporated herein by reference in its entirety.

In view of the foregoing, there is a need for simplifying the process of temporarily supporting a sucker rod assembly in an oil or gas well for suspension or well servicing operations.

SUMMARY OF THE INVENTION

In one aspect of the present invention, there is provided a method for supporting a sucker rod string and associated downhole pumping equipment on a tubing string inlet or an upper extension thereof, during preparation of a wellhead for suspension of an oil or gas well, the method comprising: a) lifting and supporting the sucker rod string and partially disassembling the wellhead to expose an uphole end of the sucker rod assembly; b) engaging a support tool to a portion of the uphole end of the sucker rod assembly, the support tool having: i) an upper wide diameter portion with a substantially horizontal landing surface wider than the inner diameter of the tubing string inlet or the upper extension thereof; and ii) a lower narrow portion configured to fit inside the tubing string inlet or the upper extension thereof; and c) lowering the sucker rod string into the tubing string inlet or the upper extension thereof, until the lower narrow portion enters the tubing string inlet or the upper extension thereof, and the landing surface of the support tool rests upon the top edge of the tubing string inlet or the top edge of the upper extension thereof.

In some embodiments, the method further comprises the step of coupling a support tool protector to an outer sidewall of the tubing string inlet or the upper wellhead extension thereof, thereby covering and protecting the upper wide diameter portion of the support tool.

In some embodiments, the landing surface has an outer diameter greater than the inner diameter of the tubing string inlet or the upper wellhead extension thereof.

In some embodiments, the support tool includes one or more longitudinal slots for use in injection of preservative fluids into the well's tubing string for preservation of the associated downhole pumping equipment remaining in the tubing string, or for injection of steam, fluids and/or chemicals to enhance production of gas or oil from the well.

In some embodiments, the support tool includes one or more longitudinal slots for use in production of oil or gas from the well's tubing string when the support tool is in place on the tubing string or the wellhead assembly.

In some embodiments, the narrow portion includes a tapered section.

In some embodiments, the lifting and lowering steps are performed using an artificial lift.

In some embodiments, the artificial lift is a pumpjack, a progressive cavity screw pump, a hydraulic system, an electrical drive reciprocating system or a belt drive reciprocating system.

In some embodiments, the lifting and lowering steps are performed using a secondary lifter.

In some embodiments, the secondary lifter is a crane, a drilling rig, a service rig a mast lifter, a hydraulic jacking system, or an electrical jacking wire system.

Another aspect of the invention is a tool for use in suspending operation of an oil or gas well driven by an artificial lift with a polished rod connected to a sucker rod in a tubing string, the tool comprising a body including: a) a lower narrow portion dimensioned to fit within the interior cavity of a tubing string inlet or an upper extension thereof; b) an upper wide diameter portion defining a substantially horizontal landing surface dimensioned to rest upon the top edge of the tubing string inlet or the upper extension thereof; c) one or more sucker rod-engaging structures; and d) one or more longitudinal slots extending through the lower narrow portion and the upper wide diameter portion to allow passage of fluid or gas through the tool when the tool is supported on the top edge of the tubing string inlet or the upper extension thereof.

In some embodiments, the outer sidewall of the lower narrow portion is tapered or chamfered to facilitate entrance of the lower narrow portion into the tubing string inlet or the upper extension thereof.

In some embodiments, the one or more sucker rod-engaging structures are provided by a central interior longitudinal cavity spanning the length of the tool, the cavity continuous with a longitudinal slot in the outer sidewall of the tool spanning the length of the tool, wherein the sucker rod is held within the longitudinal cavity and the longitudinal slot allows passage of the fluid or gas when the tool is supported on the top edge of the tubing string inlet or the upper extension thereof.

In some embodiments, the longitudinal cavity has an inwardly tapered portion beginning at the upper surface of the wide diameter portion and the inwardly tapered portion is dimensioned to retain a lower portion of a sucker rod upset.

In some embodiments, the landing surface of the wide diameter portion meets the sidewall of the lower portion of the tool at about a 90 degree angle.

In some embodiments, the one or more sucker rod engaging elements comprises a lower threaded end on the a lower narrow portion, the lower threaded end provided for attachment to a first rod coupler for threading connection of the lower portion of the support tool to an upper exposed end of a sucker rod string.

In some embodiments, the one or more sucker rod engaging elements further comprises an upper threaded end extending above the wide diameter portion, the upper threaded end provided for attachment of a second rod coupler for threading connection of the upper portion of the support tool to a secondary rod provided for connection to a lifter.

In some embodiments, the support tool further comprises an upper spacer segment between the wide diameter portion and the upper threaded end, and a lower spacer segment between the narrow diameter portion and the lower threaded end, the upper and lower spacer segments each having opposed flat wrench-landing surfaces to facilitate connection and removal of the tool from the first and second sucker rod couplers.

In some embodiments, the one or more channels comprises a plurality of channels spanning the length of the wide portion and the narrow portion.

In some embodiments, the plurality of channels is four channels equi-spaced on the circumference of the wide portion.

Another aspect of the invention is a kit for use in a process for suspending operation of an oil or gas well, the kit comprising: a tool as described herein; and instructions for coupling the tool to a sucker rod string and lowering the landing surface of the tool onto the tubing string inlet or the upper extension thereof.

In some embodiments, the kit further comprises a combination of support tool retention elements, the combination comprising: a) a hollow body adapter configured for attachment to the tubing string inlet or the upper extension thereof, to provide an upper surface for supporting the landing surface of the tool, and b) a hollow body tool protector configured for covering at least part of the upper portion of the tool, when landed on the top edge of the tubing string inlet or the upper extension thereof, and further configured for attachment to the adapter.

In some embodiments, the tool includes upper and lower rod engaging elements and the kit further comprises a plurality of rod couplers for connecting the rod engaging elements to rods.

In some embodiments, the kit further comprises a combination of support tool retention elements, the combination comprising: a) a hollow body tool protector configured for covering at least part of the upper portion of the tool, when landed on the top edge of the tubing string inlet or the upper extension thereof, and further configured for attachment to the adapter; and b) a hollow body adapter configured for attachment to the protector, the adapter configured for connection to an upper wellhead assembly.

BRIEF DESCRIPTION OF THE DRAWINGS

Various objects, features and advantages of the invention will be apparent from the following description of particular embodiments of the invention, as illustrated in the accompanying drawings. Emphasis is placed upon illustrating the principles of various embodiments of the invention. Similar reference numerals indicate similar components.

DETAILED DESCRIPTION OF THE INVENTION

Introduction

Figure 1A:
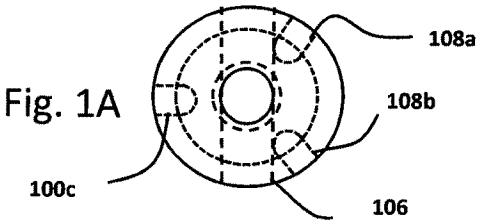
FIG. 1A is a top view of a support tool 100 in accordance with one embodiment of the invention.
Figure 1B:
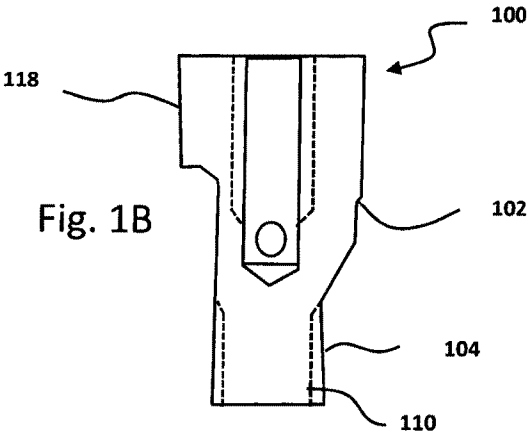
FIG. 1B is a side elevation view of the embodiment of FIG. 1A in the same orientation as FIG. 1A.
Figure 1C:
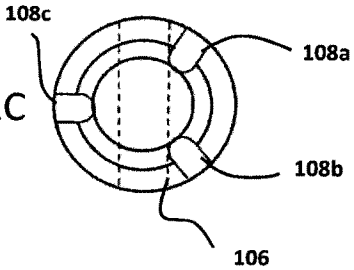
FIG. 1C is a bottom view of the embodiment of FIGS. 1A and 1B in the same orientation as FIGS. 1A and 1B.
Figure 1D:
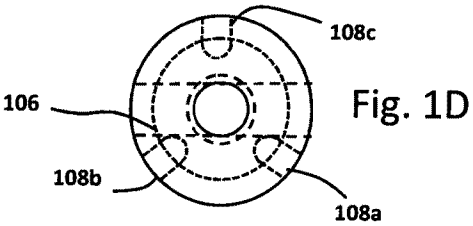
FIG. 1D is a 90 degree rotation of the top view of FIG. 1A.
Figure 1E:
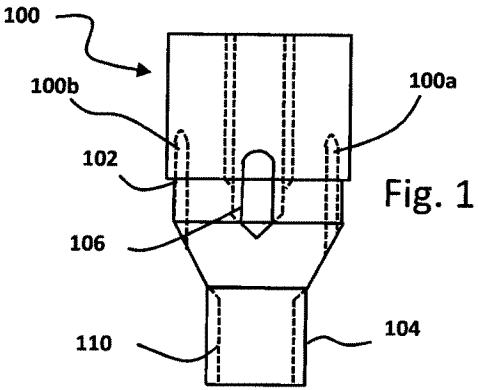
FIG. 1E is a 90 degree rotation of the side elevation view of FIG. 1B.
Figure 1F:
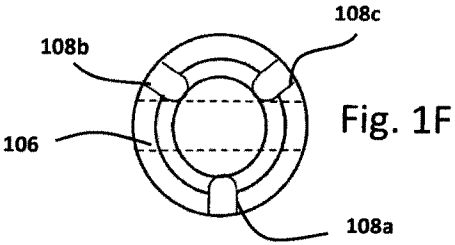
FIG. 1F is a 90 degree rotation of the bottom view of FIG. 10.

The present invention provides a method to support a sucker rod string and downhole pumps (sucker rod assembly) safely within a well. It allows the equipment to be suspended in an inhibited environment protecting it from corrosion. With at least part of the upper the pumping wellhead system removed and a standard wellhead installed, it allows the well to be properly suspended protecting the environment from leaking gases and fluids.

The sucker rod assembly is suspended using a support tool. In one embodiment, the support tool is installed below the sucker rod upset and the rod string and support tool are lowered into the well allowing the support tool to rest on the top edge of the tubing string inlet or upper extension thereof, which may include one or more upper wellhead components and/or adapters. Then the sucker rod assembly is safely suspended in the tubing string of the well. In some embodiments, the support tool threads onto the male threads of the top sucker rod of the sucker rod assembly either directly or via intermediate rod couplers and the rod assembly and tool are lowered into the well allowing the tool to rest on the top edge of the tubing string inlet or upper extension thereof. Then the rod string is safely suspended in the tubing string of the well.

All embodiments of the tool include slots through the body of the tool to allow for fluid and pressure bypass.

The support tool can be utilized in well servicing operations. During the time of installation or removal, it allows operations to be shut down and the sucker rod assembly to be suspended and secured safely any time during the operation. Operations may be suspended from a few minutes to days. When operations commence, the support tool is removed and the sucker rod assembly can then be lowered or pulled from the well.

The method and tool of the invention allows a well to be suspended safely and securely for variable periods of time. The well can be easily reactivated by the re-installation of the pumping wellhead and polished rod without requiring a service rig operation.

Rationale

The number of wells which are currently suspended in Canada exceeds 80,000. The Alberta Energy Regulator (AER) has issued requirements for suspending wells in a safe condition.

In the recently issued directive 013: Suspension Requirements for Wells, the previously existing regulations were augmented with a program entitled "The Inactive Well Compliance Program" (AER Bulletin, 2014-19). The program was introduced to address the increasing number of inactive wells. As of Apr. 1, 2015, each licensee is required to bring a minimum of its inactive well inventory into compliance with the new regulations. It is expected that the remaining oil and gas producing regions in Canada will adopt these regulations.

In the United States, the recent decrease in oil prices has resulted in inactivation of 50,000 to 100,000 wells, each of which will require safe and cost effective suspension.

It is therefore clear that a simpler and more cost effective solution to suspension of oil and gas wells is needed.

The present inventors have recognized that a majority of the costs associated with suspension of wells (with an aim to re-activate in the future) is due to the removal and replacement of downhole equipment, in particular the sucker rod string and pump. In considering this problem, the inventors have recognized that it is possible that this equipment may be left in place, provided it is properly supported within the well. It is not appropriate to lower the sucker rod string and pump to the bottom of the well because the connected sucker rods are not designed to be left in compression. Breakage of a sucker rod string will lead to increased service costs. The inventors recognized that the sucker rod assembly could be safely and effectively supported on the tubing string of a well and properly preserved using anti-corrosion fluid. The inventors have recognized that the top edge of a typical tubing string inlet or an upper extension thereof, which may include wellhead assembly components and/or adapters, will have sufficient strength to support the weight of a sucker rod string and pump. Embodiments of the support tool described herein allow the sucker rod string to be supported by the top edge of the tubing string or an upper extension thereof and to allow the injection of anti-corrosion fluids into the tubing string, thereby preserving the condition of the sucker rod string and pump, and any other downhole equipment which may be present and associated with the sucker rod string.

The present inventors have also recognized that the support tool may be used to support a partially constructed sucker rod string during a process of assembly and deployment or disassembly and withdrawal of a sucker rod string. A service rig is typically used to insert and remove individual sucker rods from a sucker rod string. For a well having depths in excess of 2000 meters, a service rig will require greater than one full day of operation and this requirement leads to overtime work of the service rig and its crew. Temporary support of the partially constructed sucker rod string can now be provided by the support tool of the present invention as described hereinbelow. Such temporary support of the partially constructed sucker rod string is expected to provide significant cost savings by permitting a service rig crew to operate without expensive overtime costs.

Proper suspension of a well ensures that the environment is protected, liability is reduced, assets are protected, the reservoir is maintained and secure and operating costs are reduced. Reactivation of a well is simple and cost-effective and can be done by simply reversing the process steps used to suspend the well using the support tool.

As an example, it is calculated that suspension of a single well using the support tool of the invention will lead to cost savings of approximately $70K for a well with a depth of 1500 meters. Cost savings come from preservation of the sucker rod assembly for later use and from a reduced requirement for well services (service rig, equipment transportation and rentals).

Definitions

As used herein, the term "well suspension" or the related term "suspending a well" refers to temporary closure of a well.

As used herein, the term "sucker rod-engaging elements" are defined as any structural feature of the body of the support tool which is provided for coupling or engaging the sucker rod by the support tool, when the support tool is in use. In one embodiment, the sucker rod-engaging elements of the support tool are provided by the combination of the longitudinal cavity and the longitudinal slot which is continuous therewith. In another embodiment, the sucker rod-engaging elements of the support tool are provided by at least one threaded end for threadingly attaching a sucker rod connector, such as a conventional sucker rod coupling. In other embodiments of sucker rod coupling elements, the body of the support tool is provided with grooves to facilitate clamping of the support tool to a sucker rod.

As used herein, the term "sucker rod" refers to a single rod which is used to connect to other sucker rods to join together the surface and downhole components of a reciprocating piston pump installed in an oil well. Common examples of sucker rods are steel rods between 25 and 30 feet (7 to 9 meters) in length, and threaded at both ends. The pumpjack is the visible above-ground drive for the well pump, and is connected to the downhole pump at the bottom of the well by a series of interconnected sucker rods. Sucker rods may also be made of fiberglass. These fiberglass sucker rods are typically terminated in metallic threaded ends, female at one end and male at the other. A series of connected sucker rods from the top of the pump to the polished rod connection is known as a "sucker rod string."

Figure 2:
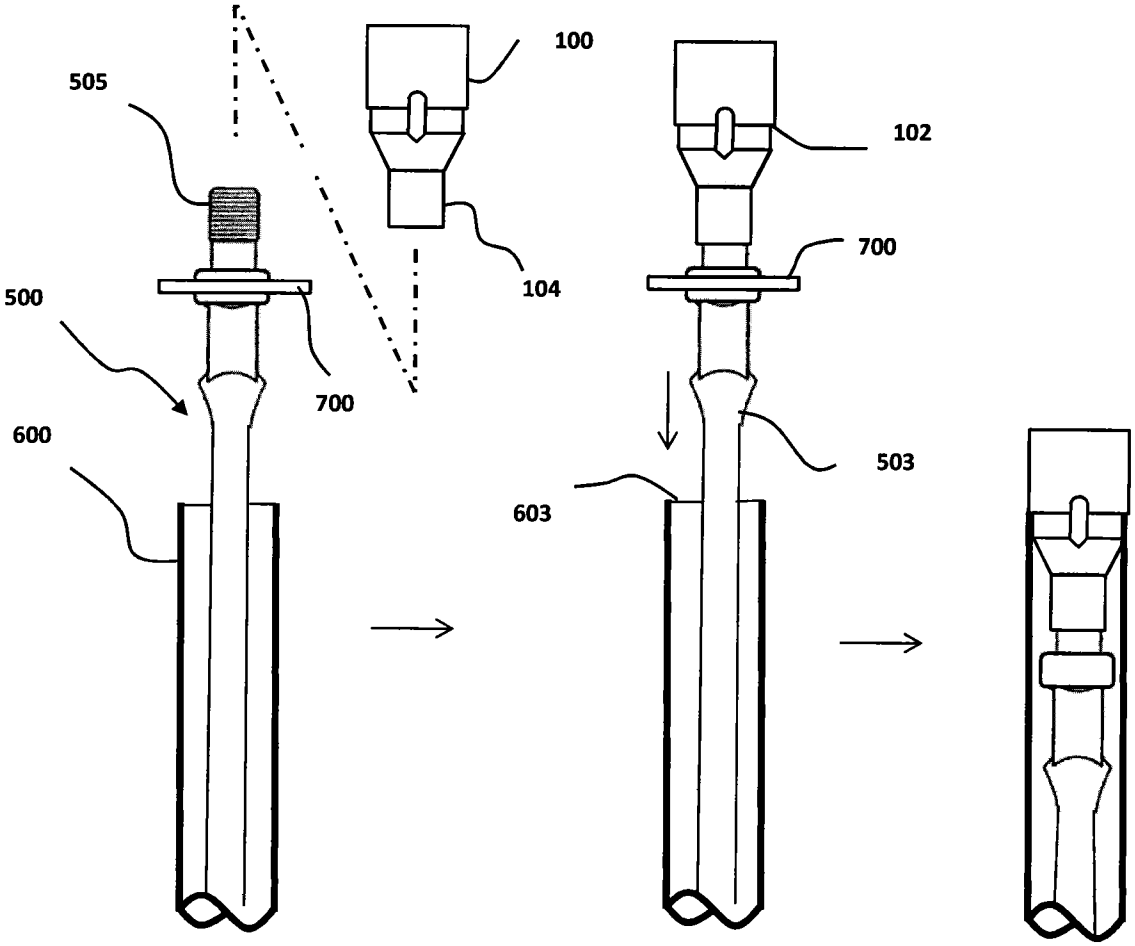
FIG. 2 is a schematic flow diagram indicating connection of the support tool 100 to a sucker rod string and landing of the connected support tool 100 on the top edge of a tubing string inlet 600.
Figure 3A:
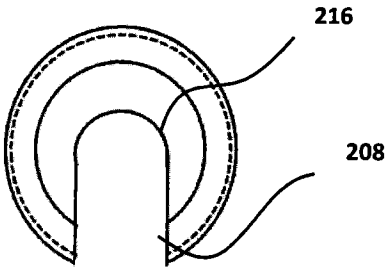
FIG. 3A is a top view of a support tool 200 in accordance with another embodiment of the invention.
Figure 3B:
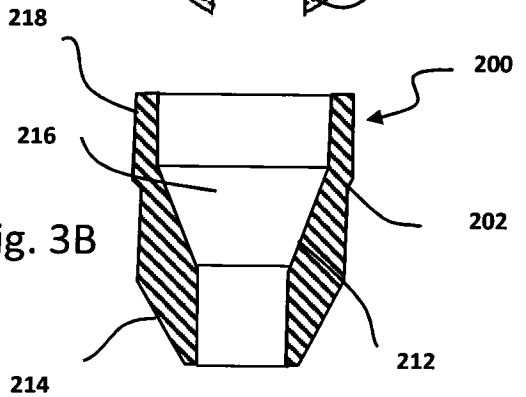
FIG. 3B is a side elevation view of the embodiment of FIG. 3A.
Figure 3C:
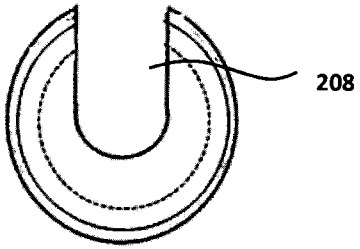
FIG. 3C is a bottom view of the embodiment of FIGS. 3A and 3B.
Figure 3D:
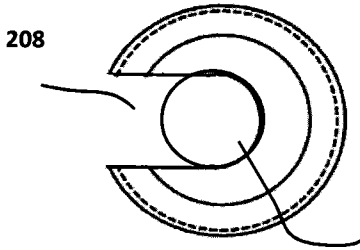
FIG. 3D is a 90 degree rotation of the top view of FIG. 3A. Additionally, a cross sectional view of a sucker rod 500 in the longitudinal opening 204 is shown.
Figure 3E:
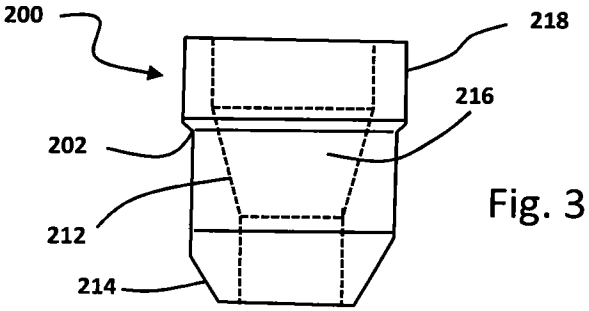
FIG. 3E is a 90 degree rotation of the side elevation view of FIG. 3B.
Figure 3F:
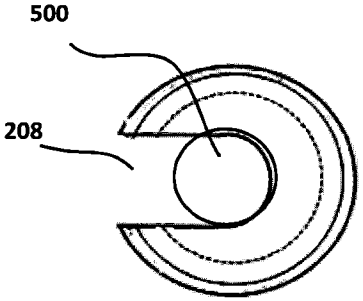
FIG. 3F is a 90 degree rotation of the bottom view of FIG. 3C. Additionally, a cross sectional view of a sucker rod 500 in the longitudinal opening 204 is shown.

As used herein, the terms, "upset," "pin upset" and "sucker rod upset" are synonymous and refer to the flared portion at the pin of a sucker rod adjacent to its threaded pin, as seen, for example, in FIG. 2.

As used herein, the term "sucker rod assembly" refers to the combination of the sucker rod string, the bottom pump, and any other downhole components associated with the bottom pump.

As used herein, the term "sucker rod system" refers to the system which includes the entire wellhead components including all valves, any tubing on surface or downhole, the bottom pump, sucker rods, the polished rod and all required clamps and additional materials.

As used herein, the term "tubing string" refers to a continuous pipe in a well which is used for extraction of oil or gas and includes any up-hole tubing string adapter components connected to the main continuous tubing string, such as a tubing bonnet, for example. A tubing string is supported in the casing of a well by a tubing string hanger in the tubing heads of a wellhead. When a wellhead is partially disassembled while the tubing string hanger remains installed, the tubing string continues to be supported. This allows a sucker rod assembly to be supported on the tubing string inlet or upper extension thereof, using the tool and method of the invention.

As used herein, the term "tubing string inlet" refers to the open uphole terminus of the tubing string. The tubing string inlet may be located at a tubing head adapter, tubing bonnet, or any other adaptive structure at the uphole end of the tubing string. As used herein, the related term "tubing string inlet or upper extension thereof" refers to the tubing string inlet as defined above, and further including any extension component above the tubing string inlet which extends the cavity of the tubing string. Components representing the "upper extension thereof" may include any wellhead component or adapter thereof that extends the cavity of the tubing string above the tubing string inlet. In one particular example shown in FIG. 8, the upper extension of the tubing string inlet ends at the flow tee 940 and a nipple adapter 450 is connected thereto to provide the end of the extension above the tubing string inlet. The cavity of the tubing string is thus extended upward to the open end of the nipple adapter 450 and the tool 400 is landed on the top edge of the nipple adapter 450 which acts as the upper extension of the tubing string inlet.

As used herein, the term "landing surface" refers to a surface of a support tool which lands on the tubing string inlet or upper extension thereof, during the process of engaging the support tool to the sucker rod assembly.

As used herein, the term "polished rod" refers to a rod which connects the top sucker rod of a sucker rod string to an artificial lift.

As used herein, the term "artificial lift" can include any of the following systems: a progressive cavity screw pump (a rotating system), a pumpjack, hydraulic systems, electrical or belt drive reciprocating system. Any of these artificial lift systems can operate using a polished rod and a sucker rod assembly.

As used herein, the term "pumpjack" refers to the overground drive for a reciprocating piston pump in an oil well. The term is synonymous with the following terms: "oil horse," "donkey pumper," "nodding donkey," "pumping unit", "horsehead pump," "rocking horse," "beam pump," "dinosaur," "Big Texan," "thirsty bird," and "jack pump,"

As used herein, the term "lifter" refers to any means for raising, lowering and temporarily supporting a sucker rod string.

As used herein, the term "wellhead assembly" refers to an assembly of components located at the head of a well which are required for the operation of a well. The assembly may include, but is not limited to casing heads, tubing heads, a tubing hanger, a tubing head adaptor, valves, a flow tee, a nipple adaptor, a wellhead cap, bull plugs, needle valves, pressure gauges, a rod blowout preventer, a stuffing box, an anti-pollution system and any additional equipment which is connected to the wellhead which is required to produce or shut in and secure the well.

Description of Embodiments

Various aspects of the invention will now be described with reference to the figures. Similar reference numerals are used to refer to similar features or to features which provide similar functions in different embodiments, whenever possible.

A number of possible alternative features are introduced during the course of this description. It is to be understood that, according to the knowledge and judgment of persons skilled in the art, such alternative features may be substituted in various combinations to arrive at different embodiments of the present invention.

Embodiment 1: Threaded Sucker Rod Support Tool for Connection to the Sucker Rod

Referring now to FIG. 1, there is shown a first embodiment of a support tool 100. It is seen that this embodiment of the support tool 100 has upper wide and lower narrow generally cylindrical portions with a landing surface 102 at the bottom of the wide portion as illustrated in the side elevation views of FIGS. 1B and 1E. The landing surface 102 is dimensioned to have a wider diameter than the inner diameter of the tubing string inlet or the vertical inlet of a wellhead assembly. The lower narrow portion 104 of the support tool 100 has a cavity with an inner sidewall 110 with inner threads to mate with the outer male threads of a sucker rod pin (see, for example, the connection of the male threads 505 of the sucker rod 500 in FIG. 2).

The skilled person will recognize that collar-type adapters may also be used to make such threading connections and are particularly useful when a single standardized support tool is used to make connections to standard sucker rod pins of different dimensions, such as the dimensions of sucker pin rods specified by the American Petroleum Institute (API).

Returning now to FIG. 1, it is seen that the support tool 100 includes an opening 106 which is included to provide a bypass for fluids and pressure moving in and out of the tubing string. This embodiment of the support tool 100 also includes three longitudinal slots 108*a*, 108*b* and 108*c* which are included to provide points of entry for injection of preservative and/or anti-corrosive fluids to preserve the condition of the downhole equipment associated with the sucker rod string during the suspension period.

Turning now to FIG. 2, there is shown a schematic flow diagram of a method for removing a polished rod and supporting a sucker rod string and associated downhole pumping equipment on the inlet of a tubing string of an oil or gas well during preparation of the well for suspension using the embodiment of the support tool 100 shown in FIG. 1.

The method includes the steps of supporting the top sucker rod 500 of the sucker rod string above the inlet of the tubing string 600 with a lifter 700. This allows removal of the polished rod thereby exposing the male threads 505 of the uphole end of the top sucker rod 500. At this point, the lower narrow portion 104 of the support tool 100 is connected to the male threads 505 of the top sucker rod 500. Then this assembly is lowered by the lifter 700 into the tubing string 600 until the landing surface 102 of the support tool 100 rests upon the top edge 603 of the inlet of the tubing string 600. In this embodiment, the pin upset 503 resides within the interior of the tubing string 600.

At this point, the sucker rod string and all associated downhole equipment is preserved by injection of preservative fluids into the slots 108*a*, 108*b* and 108*c*. Then the well head is closed and secured in accordance with known methods and regulations. In certain embodiments, the closure includes securing the tool 100 to the top of the tubing string using a threaded collar.

Furthermore, the slots 108*a*, 108*b* and 108*c* can be used to allow production of gas or oil which may be induced to flow from reservoir pressure while the support tool 100 is in place. Such flow would be expected after a well has been suspended for some time.

In other embodiments, a tubing nipple is connected to the collar to allow connection of a valve or to any other which may be required for safety or other purposes.

Embodiment 2: Sucker Rod Support Tool with Intermediate Inner Taper Supporting the Pin Upset of a Sucker Rod Turning now to FIGS. 3A to 3F, there is shown a series of views of another embodiment of a sucker rod support tool 200. This embodiment also has a landing surface 202 dimensioned to have a wider diameter than the inner diameter of the tubing string inlet or upper extension thereof. The support tool 200 has a single longitudinal slot 208 which provides the body of the tool 200 with a C-shaped structure. The longitudinal slot 208 leading to an inner cavity 216. During use of the support tool 200, the sucker rod section 500 resides within the cavity 216 and slot 208 remains free to serves the same function as the three slots 108*a*, 108*b* and 108*c* of the tool embodiment 100 of FIGS. 1 and 2, i.e. for injection of preservative and/or anti-corrosive fluids into the tubing string. Additional features of the support tool 200 include a tapered inner sidewall 212 in the inner cavity 216 and a tapered lower guide portion 214 which facilitates insertion of the lower portion into the tubing string.

The support tool 200 may be provided with a gripping means for retaining the support tool 200 on the sucker rod before it is landed on the tubing string. Such a gripping means may be provided by an elastomeric coating or an adhesive in the inner cavity 216. Additional support tool retention means may be provided by a mechanical device. For example, the tool may be provided with a quick release bearing connector such as the connectors used for hose fittings. Other support tool retention means may be provided by attaching a weight bearing clip onto the sucker rod just below the position where the support tool 200 is placed, such that the support tool 200 will be retained by the weight bearing clip. Such support tool retention means will be readily recognized by the skilled person and adapted for in the present invention without undue experimentation. All combinations of the support tool 200 with support tool retention means are within the scope of the present invention as defined by the claims.

Figure 4:
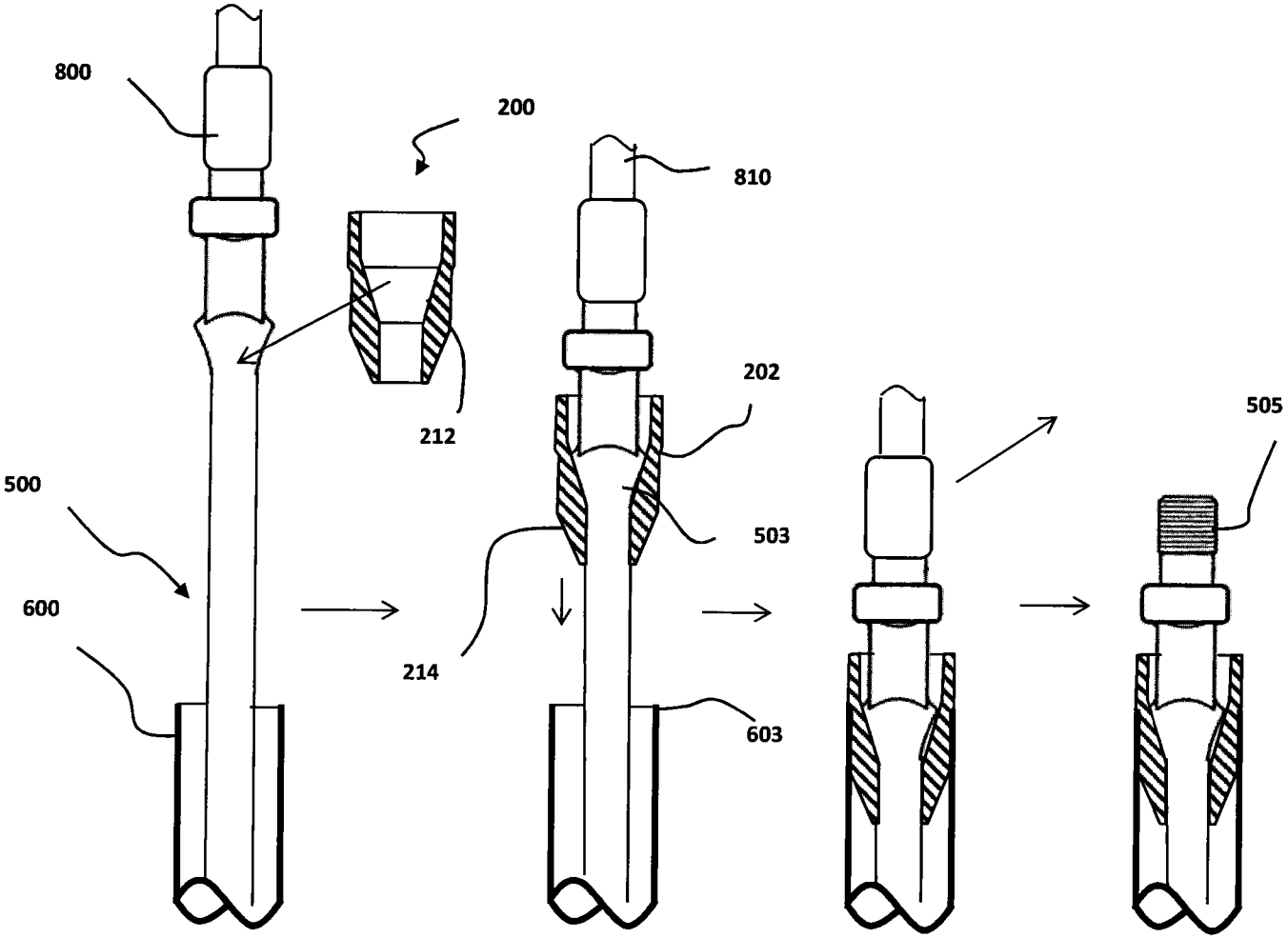
FIG. 4 illustrates a process for engaging the support tool embodiment 200 of FIG. 3 to a sucker rod string and landing of the connected support tool 200 on the top edge of a tubing string 600.
Figure 5B:
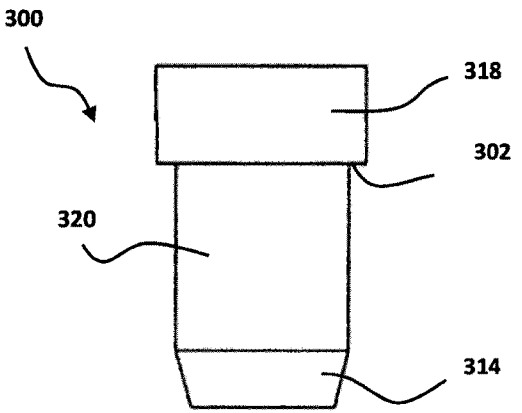
FIG. 5B is a side elevation view of the embodiment of FIG. 5A.
Figure 5D:
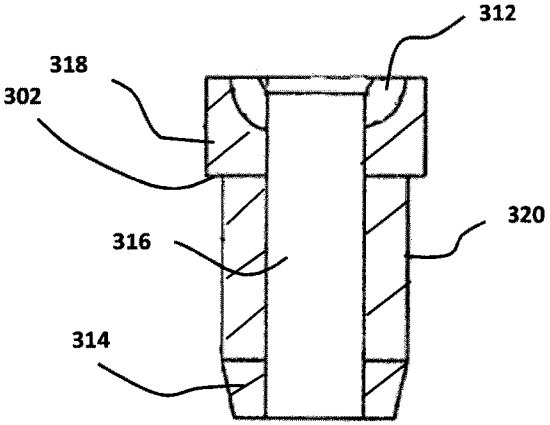
FIG. 5D is a cross sectional view taken along line 5D-5D of FIG. 5C.
Figure 5A:
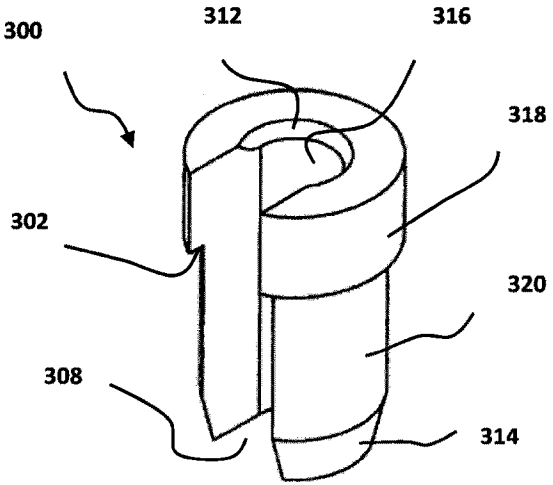
FIG. 5A is a perspective view of another embodiment 300 of the support tool.
Figure 5C:
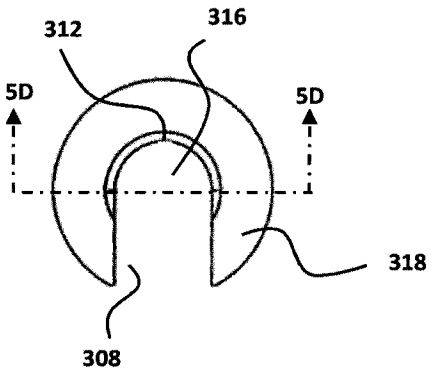
FIG. 5C is a top view of the embodiment of FIGS. 5A and 5B.

Turning now to FIG. 4, there is shown a schematic flow diagram of a method for removing a polished rod and supporting a sucker rod string and associated downhole pumping equipment in a tubing string of an oil or gas well during preparation of the well for suspension using the embodiment of the support tool 200 shown in cross-section in FIG. 3 to show placement of the sucker rod pin upset 503.

The method includes the first step of lifting the sucker rod string using the polished rod 810 connected to the pumpjack (not shown) or other artificial lift to provide access to an upper section of the top sucker rod 500 of the sucker rod string. Next the sucker rod support tool 200 is slotted over a section of the top sucker rod 500 just below the pin upset 503. This allows the tapered inner sidewall 212 of the support tool 200 to support the tapered sucker rod pin upset 503. Then the artificial lift is then used to lower the assembly into the tubing string 600 until the landing surface 202 of the support tool 200 rests on the top edge 603 of the tubing string 600. With support of the sucker rod string by the support tool 200, the connector collar 800 used to connect the top sucker rod 500 to the polished rod 810 can then be removed, exposing the male threads 505 of the top sucker rod 500.

At this point, the sucker rod string and all associated downhole equipment can be preserved by injection of preservative fluids into the slot 208. Then the wellhead can be closed and secured in accordance with known methods and regulations. In certain alternative embodiments as described above, the closure includes securing the tool to the top of the tubing string using a threaded collar.

Furthermore, the slot 208 can be used to allow production of gas or oil which may be induced to flow from reservoir pressure while the support tool 100 is in place. Such flow would be expected after a well has been suspended for some time.

In other embodiments, an adapter of the type known in the art as a "tubing nipple" is connected to the collar to allow connection of additional protective wellhead components or adapters.

Embodiment 3: Sucker Rod Support Tool with Inner Taper from its Upper Surface for Supporting the Pin Upset of a Sucker Rod Another embodiment of the support tool 300 is illustrated with reference to FIGS. 5A to 5D.

This embodiment 300 also has an upper wide portion 318 a lower narrow portion 320 and a substantially horizontal landing surface 302 dimensioned to have a wider diameter than the inner diameter of the tubing string inlet or the vertical inlet of a wellhead assembly. The support tool 300 has a single longitudinal slot 308 which provides the body of the tool 300 with a C-shaped structure in a manner similar to embodiment 2. The longitudinal slot 308 can be inserted against a section of a sucker rod below the pin upset. Thus the sucker rod section resides within the cavity 316 and the remaining slot 308 serves the same function as the three slots 108*a*, 108*b* and 108*c* of the support tool embodiment 100 and the slot 208 of the support tool embodiment 200, i.e. for injection of preservative and/or anti-corrosive fluids into the tubing string or for injection of steam, fluids and/or chemicals to enhance production of gas or oil from the well, which can be done while any of the tool embodiments is supporting a sucker rod. Additional features of the support tool 300 include a tapered inner sidewall 312 for the inner cavity 316 which begins from the upper surface of the wide diameter portion 318. There is also a tapered lower guide portion 314 which facilitates insertion of the lower portion 320 into the inlet of the tubing string.

Figure 6A:
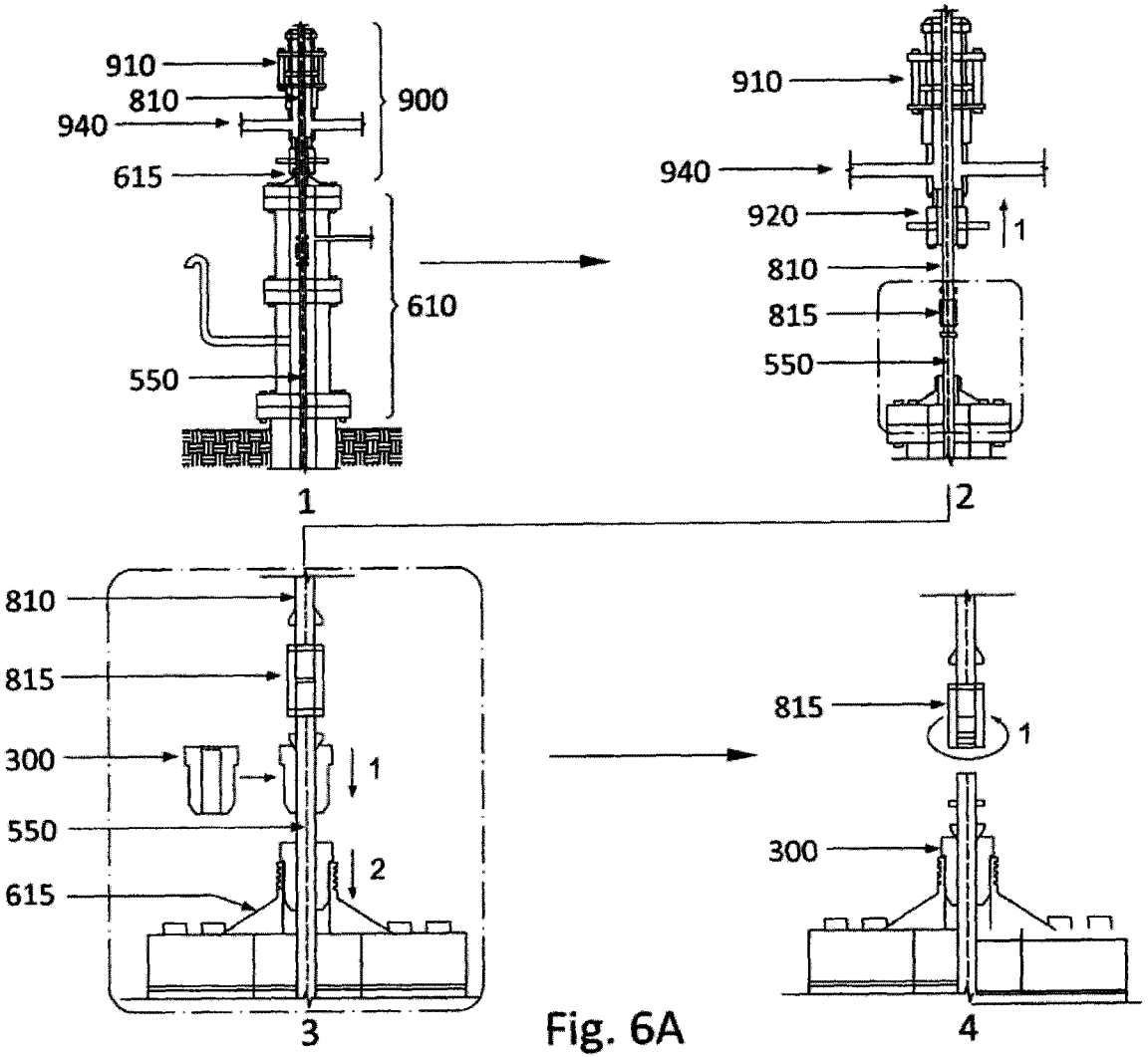
FIGS. 6A and 6B illustrate a process for engaging support tool 300 to an upper sucker rod of a sucker rod string and landing the support tool 300 on a tubing string inlet on a tubing head adapter 615. The process also includes connection of a collar 360 to the outer sidewall of the tubing head adapter 615 and connection of a nipple adapter 350 to the collar 360.
Figure 6B:
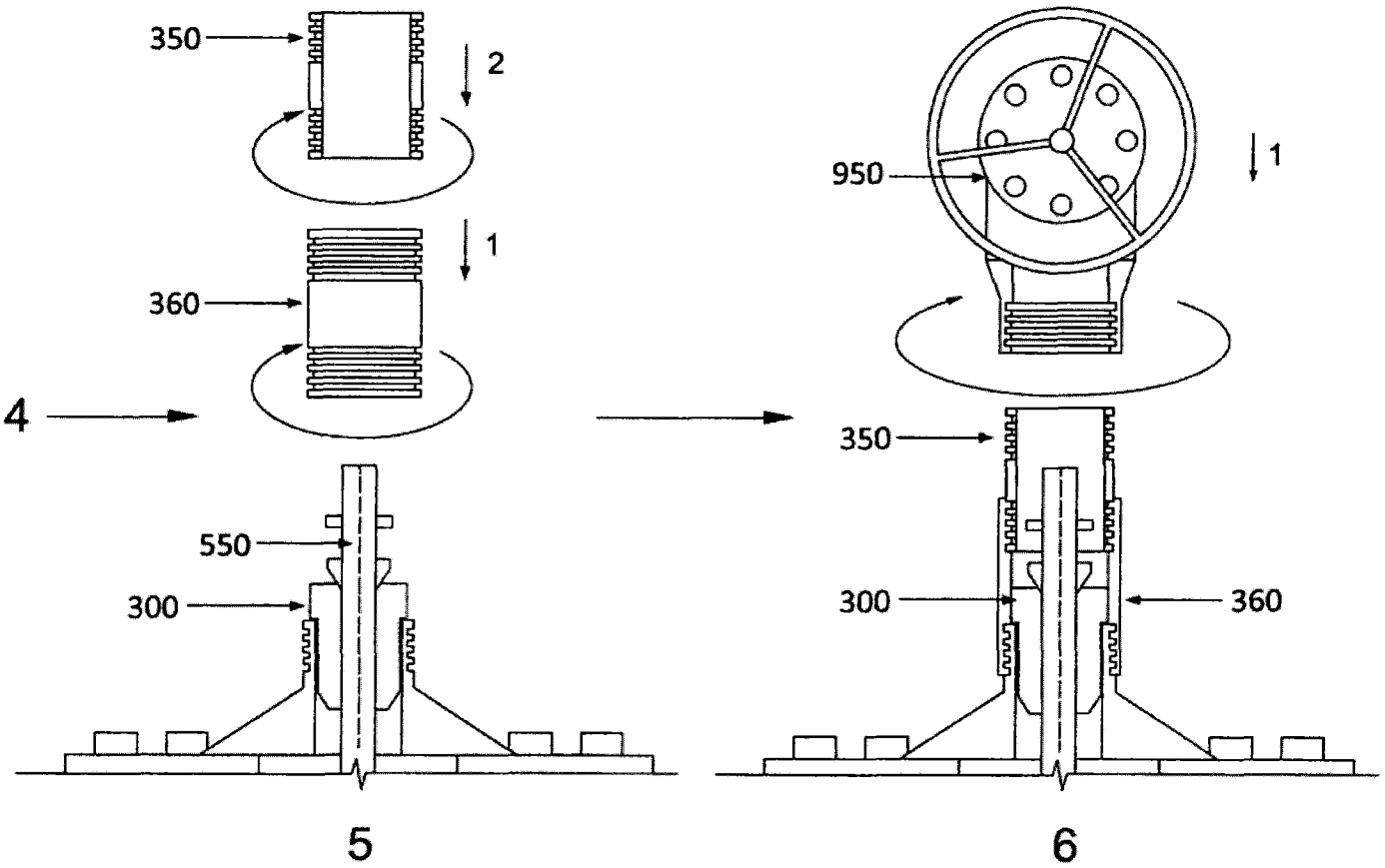

A process for removing a polished rod and supporting a sucker rod assembly and associated downhole pumping equipment on a tubing string inlet is shown in FIGS. 6A and 6B. This process is envisioned for use in a long-term well suspension operation where the well remains suspended for months or years at a time (as opposed to a short-term service-type well suspension which involves suspension for a number of hours).

In this example process, the initial up-hole equipment shown at position 1 (FIG. 6A) includes a series of tubing heads 610 which includes a tubing head adapter 615 and an upper pumping wellhead assembly 900 which includes a flow tee 940 a polished rod 810 (connected to rod string 550) and a stuffing box 910. At this point, the polished rod 810 is raised using a pumpjack or other lifting equipment to unseat the bottom hole pump. The production of the well is killed according to conventional processes at this point.

At position 2 (FIG. 6A), the stuffing box 910 is unseated and the wellhead is separated at the pre-determined position for installation of the support tool 300. The upper components of the wellhead including the rod blowout preventer (BOP) 920, the flow tee 940 and the stuffing box 910 are removed and the rod string 550 is exposed above the tubing head adapter 615.

At position 3 (FIG. 6A), the support tool 300 is installed on an upper position of the rod string 550 directly below the pin upset of the uppermost rod of the rod string 550 (i.e. the sucker rod which is connected to the polished rod 810) by aligning the longitudinal slot 308 with the axis of the rod string and pushing the support tool 300 onto the rod string 550 so that the a section of the rod string 550 is housed within the cavity 316 of the support tool 300. Then the rod string 550 is lowered into the tubing string until the lower narrow portion 320 of the support tool 300 resides inside the tubing string and the landing surface 302 of the support tool 300 rests upon the upper edge of the tubing head adapter 615 which serves the function of the tubing string inlet. The upset portion of the uppermost sucker rod sits in the tapered inner sidewall 312 of the cavity 316. As such, the tapered inner sidewall 312 acts as a nest for the lower end of the upset portion of the uppermost sucker rod.

At position 4 (FIG. 6A), it is shown that the polished rod 810 is removed at this point by uncoupling the polished rod coupler 815. This effectively removes support of the rod string 550 by the pumpjack or secondary lifter and the entire weight of the rod string 550 is now supported by the landing surface 302 of the support tool 300 on the tubing head adapter 615 which acts as the inlet of the tubing string.

At position 5 (FIG. 6B), it is shown that a hollow body collar 360 with inner threads is threaded onto the lower outer threads of the tubing head adapter 615 to completely cover the exposed upper wide portion 318 of the support tool 300. Then a nipple adapter 350 with outer threads is threaded into the collar 360. The combination of the collar 360 and nipple adapter 350 provides protection for the support tool 300 and acts to reinforce the upper wide diameter portion 318 of the tool, preventing deformation of the wide diameter portion 318 by the force of gravity acting on the entire mass of the sucker rod string 550. In certain embodiments, the collar 360 and the nipple adapter 350 are painted a similar distinguishing color (such as red, for example) so that they can be easily distinguished as representing specific support tool-related components.

Finally at position 6 (FIG. 6B), the wellhead assembly 950 is threaded onto the upper threads of the nipple adapter 350. At this point, corrosion inhibitors can be pumped into the tubing string via the wellhead assembly 950 and the longitudinal slot 308 of the support tool 300 to preserve the sucker rod string 550 and associated downhole equipment during the period of suspension of the well. When the suspension period is complete and reactivation of the well is desired, the steps outlined hereinabove are reversed and the well is brought back into service using the preserved sucker rod string 550.

Figure 7B:
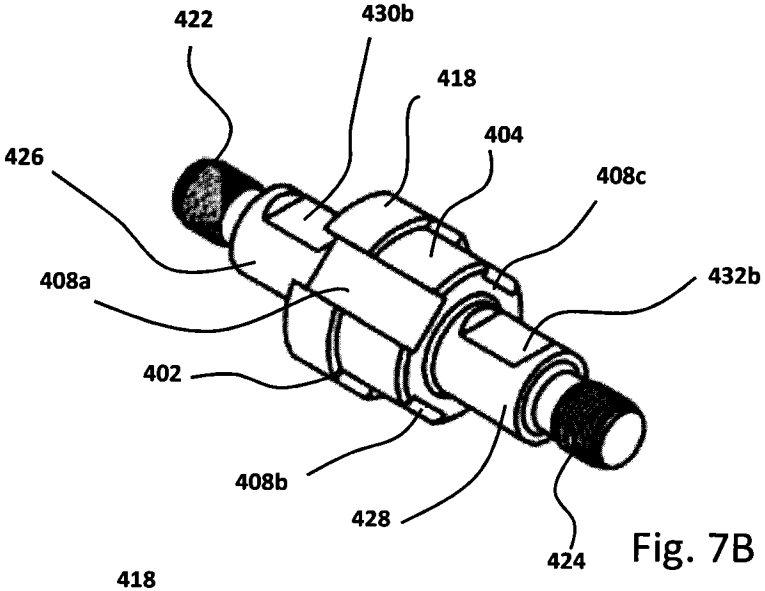
FIG. 7B is a perspective view of the same embodiment 400 of FIG. 7A.
Figure 7C:
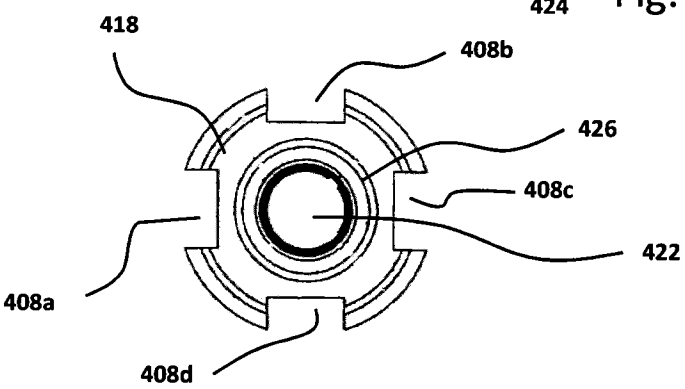
FIG. 7C is a top view of the same embodiment of FIGS. 7A and 7B.
Figure 7A:
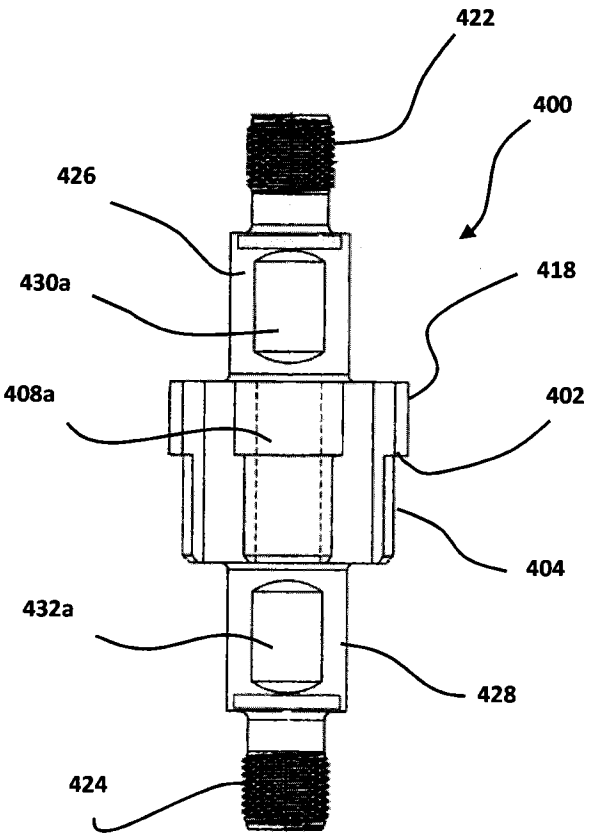
FIG. 7A is a side elevation view of another embodiment 400 of the support tool.

Embodiment 4: Sucker Rod Support Tool with Upper and Lower Threaded Ends for Connection to the Sucker Rod String and to a Secondary Upper Support Rod Another embodiment of the support tool 400 is illustrated with reference to FIGS. 7A to 7C.

This embodiment 400 also has an upper wide portion 418, a lower narrow portion 404 and a landing surface 402 dimensioned to have a wider diameter than the inner diameter of the tubing string inlet or an upper extension thereof. The support tool 400 has four equi-spaced longitudinal slots 408*a*, 408*b*, 408*c* and 408*d* formed in the wide portion 418 and extending through the narrow portion 404. When the tool 400 is installed and supports a sucker rod string in a tubing string, corrosion inhibitors can be pumped into the tubing string via the slots 408*a*, 408*b*, 408*c* and 408*d* and oil or gas can pass upward through these slots and captured using uphole equipment if necessary, while the support tool 400 is installed and the well is suspended.

The support tool 400 also has an upper spacer segment 426 which is integrally formed above the wide portion 418 and which has a diameter narrower than that of the narrow portion 404. An upper threaded end 422 is integrally formed with the upper spacer segment 426. There is also a lower spacer segment 428 with dimensions similar to that of the upper spacer segment 426 which is integrally formed below the narrow portion 404 and which also has a lower threaded end 424 integrally formed with the lower spacer segment 428. The upper and lower threaded ends 422 and 424 are provided as API standard threads for connection to standard sucker rod pins using standard sucker rod couplers or crossover couplers, or standard secondary rods such as the type known as "pony rods" which are shorter rods used for uphole support during servicing. The upper and lower spacer segments 426 and 428 are each provided with a pair of opposed wrench flats 430*a*, 430*b* and 432*a*, 432*b* which facilitate wrench gripping during connection and disconnection of rod pin couplers.

Figure 8A:
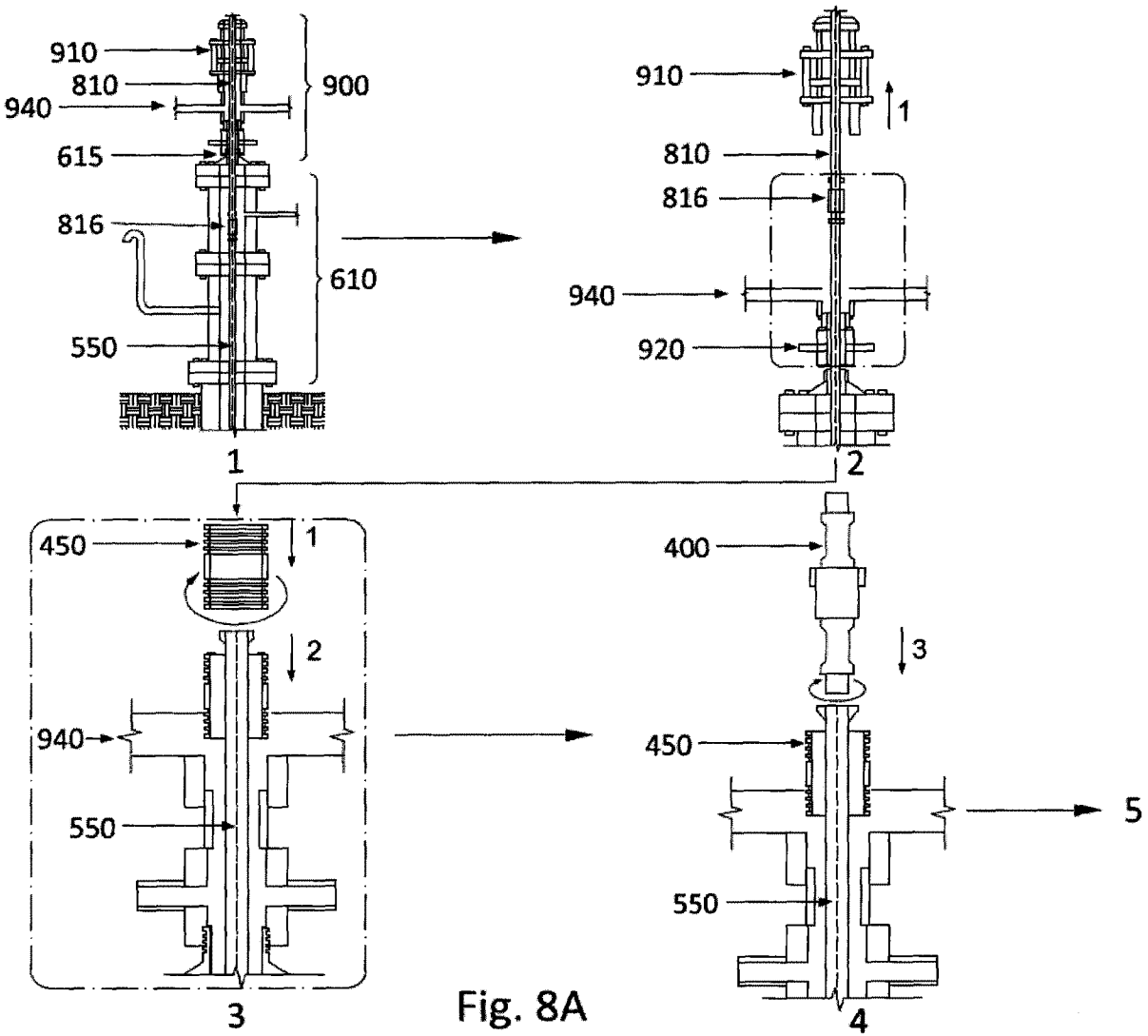
FIGS. 8A and 8B illustrate a process for engaging support tool 400 to an upper sucker rod of a sucker rod string and landing the support tool 400 on an extension of the tubing string inlet formed by the combination of a wellhead flow tee 940 and a nipple adapter 450. The process also includes connection of a collar 460 to the nipple adapter 450.
Figure 8B:
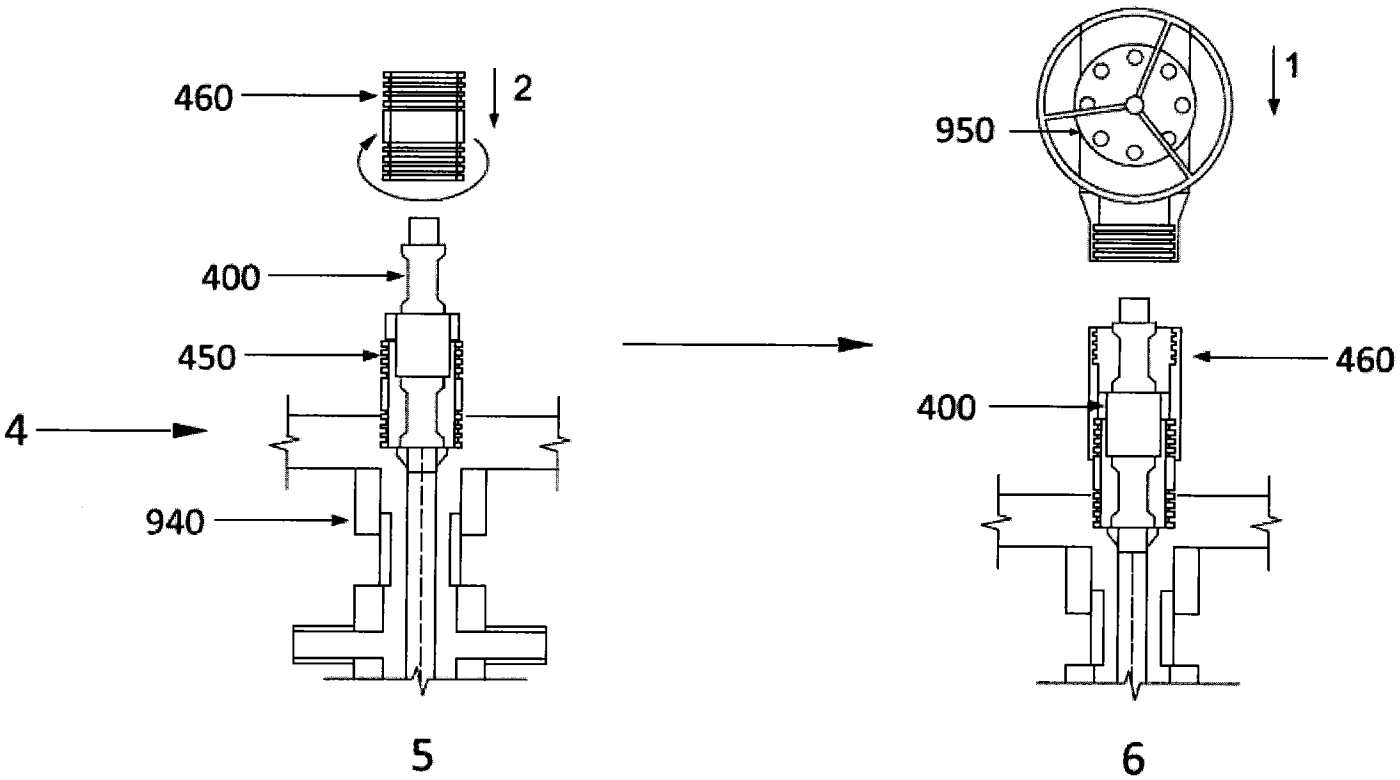

A process for removing a polished rod and supporting a sucker rod assembly and associated downhole pumping equipment on a vertical inlet of a wellhead assembly is shown in FIGS. 8A and 8B. This process, which uses support tool 400 is envisioned for use in a short-term well suspension operation wherein the well is suspended for a short period (e.g. overnight) during a well service operation (as opposed to a long-term suspension which involves suspension for several months or years).

In this example process, the initial up-hole equipment shown at position 1 (FIG. 8A) includes a series of tubing heads 610 which includes a tubing head adapter 615 and an upper pumping wellhead assembly 900 which includes a flow tee 940 a polished rod 810 (connected to rod string 550) a polished rod sub-coupling 816, a rod blow-out preventer (BOP) 920 and a stuffing box 910. At this point, the polished rod 810 is raised using a pumpjack or other lifting equipment to unseat the bottom-hole pump. The production of the well is killed by conventional processes at this point.

At position 2 (FIG. 8A), the stuffing box 910 is unseated and the upper pumping wellhead is separated at the predetermined position (upper extension of the tubing string inlet) for installation of the support tool 400, (which in this case, is at the vertical inlet of the flow tee 940, while other locations within any give wellhead assembly are also possible, provided there is an inlet with a cavity leading to the tubing string cavity). The rod string 550 is lifted and supported at the flow tee 940 (using rod elevators for example) and then the polished rod 810 is removed to expose the pin of the upper sucker rod of the sucker rod string 550.

At position 3 (FIG. 8A), a hollow body nipple adapter 450, which has an outer sidewall with upper and lower threaded ends, is placed over the exposed end of the sucker rod string 550 and placed adjacent to the flow tee 940. A secondary rod (also known as a "landing rod" or "pony rod") is then connected to the upper exposed end of the sucker rod string 550. A lifter is connected to the secondary rod and the rod elevators are disconnected while the weight of the sucker rod string 550 is supported by the lifter. This allows the nipple adapter 450 to be threaded into the vertical inlet of the flow tee 940, thereby generating a new vertical inlet of the wellhead assembly (which represents an upper extension of the tubing string inlet). The upper surface of the nipple adapter 450 provides is used as the top edge for landing of the support tool 400.

At position 4 (FIG. 8A), the rod elevators are placed the upper surface of the nipple adapter 450 to support the weight of the sucker rod string 550. This allows the lifter to be disconnected from the secondary rod and then the secondary rod itself is disconnected to expose the upper threads of the upper pin head of the sucker rod string 550. The support tool 400 is connected to the upper threads of the sucker rod string 550 via a standard sucker rod coupler (not shown). Then the rod string 550 is raised by the lifter to allow removal of the rod elevators before the rod string 550 is lowered into the tubing string until the lower narrow portion 404 (see FIGS. 7A and 7B) of the support tool 400 resides inside the tubing string and the landing surface 402 of the support tool 400 rests upon the upper edge of the nipple adapter 450 which serves the function as the upper extension of the tubing string inlet.

At position 5 (FIG. 8B), it is shown that a collar 460 is threaded onto the outer upper threads of the nipple adapter 450 to cover the majority of the upper exposed body of the support tool 400. The combination of the collar 460 and nipple adapter 450 provides protection for the support tool 400 and acts to reinforce the upper wide diameter portion 418 of the tool, preventing deformation of the wide diameter portion 418 by the force of gravity acting on the entire mass of the sucker rod string 550. In certain embodiments, the collar 460 and the nipple adapter 450 are painted a similar distinguishing color (such as red, for example) so that they can be easily distinguished as representing specific support tool-related components.

Finally at position 6 (FIG. 8B), the wellhead assembly 950 is threaded onto the upper threads of the nipple adapter 450. At this point, corrosion inhibitors can be pumped into the tubing string via the wellhead assembly 950 and the longitudinal slots 408*a-d* of the support tool 400 to preserve the sucker rod string 550 and associated downhole equipment during the period of suspension of the well. When the suspension period is complete and reactivation of the well is desired, the steps outlined hereinabove are reversed and the well is brought back into service using the preserved sucker rod string 550.

Embodiment 5—A Kit for Supporting a Sucker Rod String

Another embodiment of the present invention is a kit for supporting a sucker rod string. The kit includes a sucker rod support tool such as the tool of embodiments 1-4, or alternatives thereof, as well as instructions for using the tool to support a sucker rod string for the purpose of long-term or short term suspension of a well.

The kit may also include one or more adapters and collars for securing the support tool to the top edge of the tubing string or to a vertical inlet of a wellhead assembly.

In kits where the tool has one or more threaded ends for connection to pins of standard sucker rods, the kit also contains one or more conventional rod couplers for connecting sucker rods. In certain embodiments the couplers conform to API standards.

The kit may include various additional threading adapters to ensure that a standardized sucker rod support tool can be connected to the male threads of sucker rods of different dimensions as defined by the API standards.

Tool Materials

The support tool of the invention may be constructed of metal such as 41-40 stainless steel or any other material or composite thereof with sufficient strength to support the weight of a sucker rod assembly of any practical length. Suitable materials for construction of various embodiments of the tool may be selected by the skilled person without undue experimentation.

Alternative Embodiments

The skilled person will recognize that the principles of operation of the sucker rod support tool can be applied in other situations which do not involve suspension of an oil or gas well. One such alternative application is to support a partially constructed sucker rod string. As known by the skilled person, construction of a sucker rod assembly for a deep well traditionally would require the entire crew of a service rig extended overtime to complete. As such, supporting a partially constructed sucker rod string using the support tool and method of the present invention provides significant cost savings by dispensing with overtime requirements of a service rig and its crew.

In certain alternative embodiments, selected components from the kit may be included in the wellhead assembly of a newly constructed sucker rod system to provide a means for efficient installation of the support tool provide added convenience in suspending the well at a later date. In one example of this alternative use of the kit of the invention, the connection collar is threaded onto the tubing spool or tubing bonnet of the wellhead and the nipple collar is connected to the collar.

EXAMPLES

Example 1

Different Sizes of Support Tools of Embodiments 3 and 4

Figure 9B:
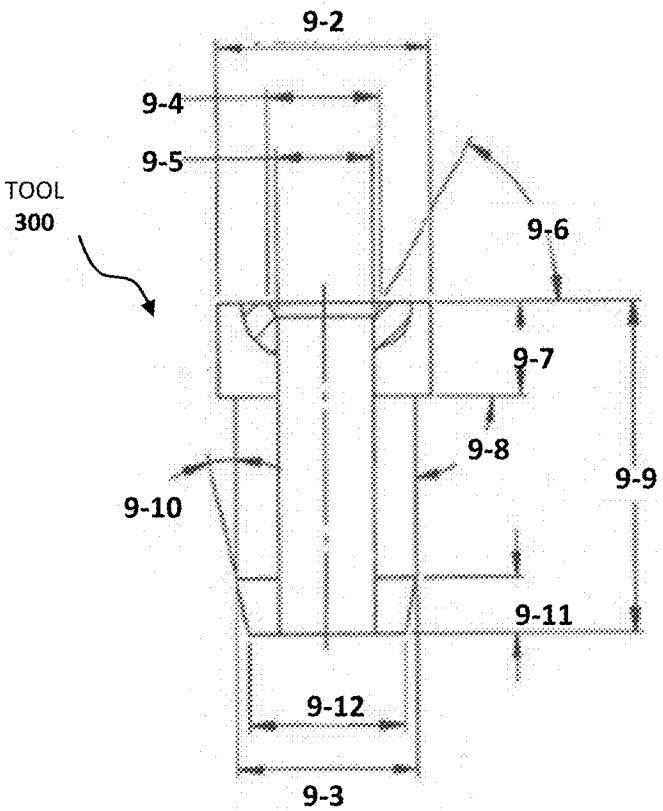
FIG. 9B is a side elevation view of the tool embodiment 300 provided for the purpose of indicating dimension lines.
Figure 9A:
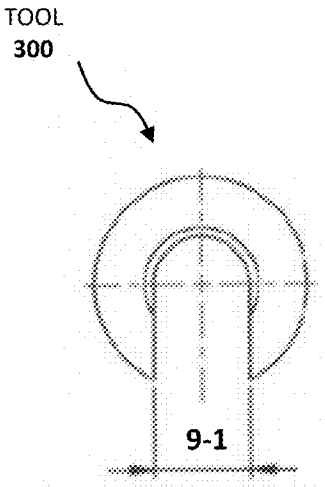
FIG. 9A is a top view of the tool embodiment 300 provided for the purpose of indicating dimension lines.
Figures 10A, 10B, 10C:
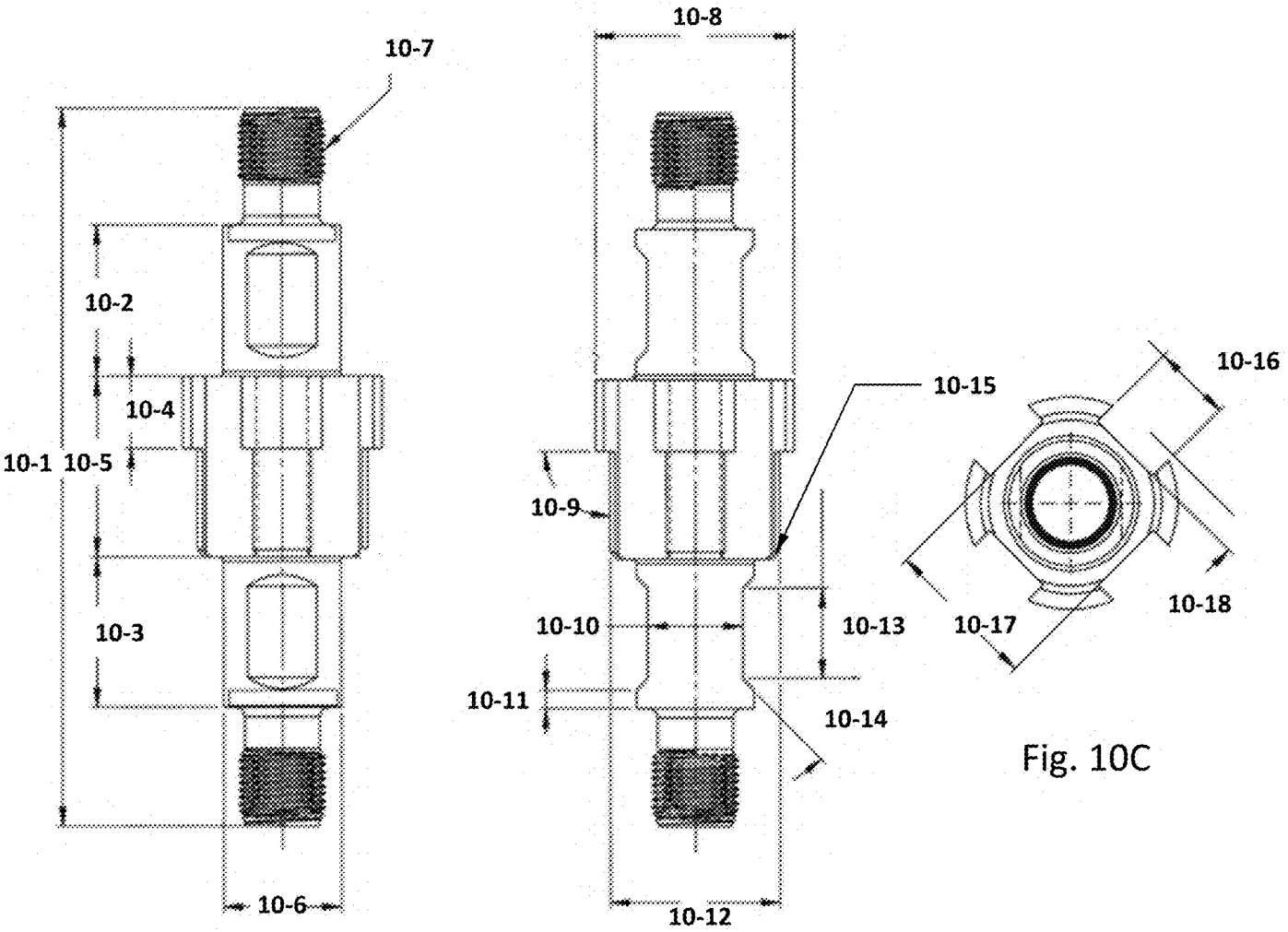
FIG. 10A is a side elevation view of the tool embodiment 400 provided for the purpose of indicating dimension lines.
FIG. 10B is another side elevation view of the tool embodiment 400 which represents a 90 degree rotation about the longitudinal axis of the tool 400, provided for the purpose of indicating dimension lines.
FIG. 10C is a top view of the tool embodiment 400 provided for the purpose of indicating dimension lines.

This example describes three differently dimensioned versions of embodiments 3 and 4 which were constructed for the purpose of performing load testing experiments (not shown). The dimensions of these sets of embodiments are indicated with reference to FIGS. 9 and 10 and Tables 1 and 2 below.

TABLE 1

| Dimensions of the Tool of Embodiments 3A, 3B and 3C | | | | |
|---|---|---|---|---|
| Identifier (FIG. 9) | Parameter | Embodiment 3A (for 2.375 inch API tubing) | Embodiment 3B (for 2.875 inch API tubing) | Embodiment 3C (for 3.5 inch API tubing) |
| 9-1 | Width of slot | 1.00 inches | 1.188 inches | 1.188 inches |
| 9-2 | OD of wide portion | 2.25 ± 0.06 inches | 2.75 ± 0.06 inches | 3.25 ± 0.06 inches |
| 9-3 | OD of narrow portion | 1.90 inches | 2.35 inches | 2.87 inches |
| 9-4 | ID of top taper edge | 1.188 inches | 1.375 inches | 1.375 inches |
| 9-5 | ID of cavity | 1.00 inches | 1.188 inches | 1.188 inches |
| 9-6 | Inner taper angle (from upper surface) | 60° | 60° | 60° |
| 9-7 | Height of wide portion | 1.00 inches | 1.00 inches | 1.00 inches |
| 9-8 | Wide to narrow transition angle | 90° | 90° | 90° |
| 9-9 | Total height of tool body | 3.50 inches | 3.50 inches | 4.50 inches |
| 9-10 | Taper angle from sidewall | 13° | 31° | 46° |
| 9-11 | Bottom taper length | 0.59 inches | 0.59 inches | 0.59 inches |
| 9-12 | Bottom taper OD | 1.63 inches | 1.63 inches | 1.63 inches |

OD = outer diameter,
ID = inner diameter

TABLE 2

| Dimensions of the Tool of Embodiments 4A, 4B and 4C | | | | |
|---|---|---|---|---|
| Identifier (FIG. 10) | Parameter | Embodiment 4A (for 2.375 In. API Tubing) | Embodiment4B (for 2.875 In. API Tubing) | Embodiment 4C (for 3.5 In. API Tubing) |
| 10-1 | Height of tool body | 9.88 inches | 9.88 inches | 9.88 inches |
| 10-2 | Height of upper spacer | 2.25 inches | 2.06 inches | 2.06 inches |
| 10-3 | Height of lower spacer | 2.25 inches | 2.06 inches | 2.06 inches |
| 10-4 | Height of wide portion | 1.00 inches | 1.00 inches | 1.00 inches |
| 10-5 | Combined height of wide and narrow portions | 2.50 inches | 2.50 inches | 2.50 inches |
| 10-6 | Width of spacer opposite wrench flats | 1.500 ± 0.008 inches | 1.625 ± 0.015 inches | 1.625 ± 0.015 inches |
| 10-7 | OD of Sucker rod pin | 0.750 inches | 0.875 inches | 0.875 inches |
| 10-8 | OD of wide portion | 2.25 ± 0.06 inches | 2.75 ± 0.06 inches | 3.25 ± 0.06 inches |
| 10-9 | Wide to narrow transition angle | 90° | 90° | 90° |
| 10-10 | With of spacer across wrench flats | 1.000 ± 0.015 inches | 1.312 ± 0.015 inches | 1.312 ± 0.015 inches |
| 10-11 | Length of spacer below wrench flats | 0.250 inches | 0.250 inches | 0.250 inches |
| 10-12 | OD of narrow portion | 1.90 inches | 2.35 inches | 2.87 inches |
| 10-13 | Length of wrench flats | 1.25 inches | 1.25 inches | 1.25 inches |
| 10-14 | Wrench flat transition angle | 45° | 45° | 45° |
| 10-15 | Chamfer of bottom of narrow portion | 0.06 inches × 45° | 0.10 inches × 45° | 0.10 inches × 45° |
| 10-16 | Width of individual slots | 0.813 inches | 1.000 inches | 1.000 inches |

TABLE 2-continued

Dimensions of the Tool of Embodiments 4A, 4B and 4C

| Identifier (FIG. 10) | Parameter | Embodiment 4A (for 2.375 In. API Tubing) | Embodiment4B (for 2.875 In. API Tubing) | Embodiment 4C (for 3.5 In. API Tubing) |
|---|---|---|---|---|
| 10-17 | Depth across tool between opposing slots | 1.580 inches | 1.850 inches | 2.125 inches |
| 10-18 | Depth of individual slots | 0.335 inches | 0.450 inches | 0.563 inches |

OD = outer diameter,
ID = inner diameter

While this example describes specific embodiments of the support tool of the invention, the skilled person will recognize that the invention is not limited to these specific embodiments and that significant departures from the structures and dimensions of the embodiments listed in Tables 1 and 2 is possible while preserving the functional characteristics of the invention.

Equivalents and Scope

Other than described herein, or unless otherwise expressly specified, all of the numerical ranges, amounts, values and percentages, in the following portion of the specification and attached claims may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains error necessarily resulting from the standard deviation found in its underlying respective testing measurements. Furthermore, when numerical ranges are set forth herein, these ranges are inclusive of the recited range end points (i.e., end points may be used).

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. The terms "one," "a," or "an" as used herein are intended to include "at least one" or "one or more," unless otherwise indicated.

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this invention belongs.

While this invention has been particularly shown and described with references to embodiments thereof, it will be understood by those skilled in the art that various changes in form and details may be made therein without departing from the scope of the invention encompassed by the appended claims.

The invention claimed is:

1. A method for supporting a sucker rod string and associated downhole pumping equipment on a tubing string inlet or an upper extension thereof, during preparation of a wellhead for suspension of an oil or gas well, the method comprising:

a) lifting and supporting the sucker rod string and partially disassembling the wellhead to expose an uphole end of the sucker rod assembly;

b) engaging a support tool to a portion of the uphole end of the sucker rod assembly, the support tool having:

i) a lower narrow portion dimensioned to fit within the interior cavity of the tubing string inlet or an upper extension thereof, the lower narrow portion comprising a lower threaded end for attachment to a first rod coupler;

ii) an upper wide diameter portion defining a substantially horizontal landing surface dimensioned to rest upon the top edge of the tubing string inlet or the upper extension thereof and an upper threaded end extending above the wide diameter portion, the upper threaded end provided for attachment of a second rod coupler;

iii) one or more longitudinal slots extending through the lower narrow portion and the upper wide diameter portion to allow passage of fluid or gas through the tool when the tool is supported on the top edge of the tubing string inlet or the upper extension thereof; and iv) an upper spacer segment between the wide diameter portion and the upper threaded end, and a lower spacer segment between the narrow diameter portion and the lower threaded end, the upper and lower spacer segments each having opposed flat wrench-landing surfaces to facilitate connection and removal of the tool from the first and second sucker rod couplers; and c) lowering the sucker rod string into the tubing string inlet or the upper extension thereof, until the lower narrow portion enters the tubing string inlet or the upper extension thereof, and the landing surface of the support tool rests upon the top edge of the tubing string inlet or the top edge of the upper extension thereof.

2. The method of claim 1, further comprising the step of coupling a support tool protector to an outer sidewall of the tubing string inlet or the upper wellhead extension thereof, thereby covering and protecting the upper wide diameter portion of the support tool.

3. The method of claim 1, wherein the landing surface has an outer diameter greater than the inner diameter of the tubing string inlet or the upper wellhead extension thereof.

4. The method of claim 1, wherein the support tool includes one or more longitudinal slots for use in injection of preservative fluids into the well's tubing string for preservation of the associated downhole pumping equipment remaining in the tubing string, or for injection of steam, fluids and/or chemicals to enhance production of gas or oil from the well.

5. The method of claim 1, wherein the support tool includes one or more longitudinal slots for use in production of oil or gas from the well's tubing string when the support tool is in place on the tubing string or the wellhead assembly.

6. The method of claim 1, wherein the narrow portion includes a tapered section.

7. The method of claim 1, wherein the lifting and lowering steps are performed using an artificial lift.

8. The method of claim 7, wherein the artificial lift is a pumpjack, a progressive cavity screw pump, a hydraulic system, an electrical drive reciprocating system or a belt drive reciprocating system.

9. The method of claim 1, wherein the lifting and lowering steps are performed using a secondary lifter.

10. The method of claim 9, wherein the secondary lifter is a crane, a drilling rig, a service rig a mast lifter, a hydraulic jacking system, or an electrical jacking wire system.

11. A tool for use in suspending operation of an oil or gas well driven by an artificial lift with a polished rod connected to a sucker rod in a tubing string, the tool comprising a body including:

a) a lower narrow portion dimensioned to fit within the interior cavity of a tubing string inlet or an upper extension thereof, the lower narrow portion comprising a lower threaded end for attachment to a first rod coupler;

b) an upper wide diameter portion defining a substantially horizontal landing surface dimensioned to rest upon the top edge of the tubing string inlet or the upper extension thereof and an upper threaded end extending above the wide diameter portion, the upper threaded end provided for attachment of a second rod coupler, the second rod coupler provided for threading connection of the upper portion of the support tool to a secondary rod provided for connection to a lifter;

c) one or more longitudinal slots extending through the lower narrow portion and the upper wide diameter portion to allow passage of fluid or gas through the tool when the tool is supported on the top edge of the tubing string inlet or the upper extension thereof; and d) an upper spacer segment between the wide diameter portion and the upper threaded end, and a lower spacer segment between the narrow diameter portion and the lower threaded end, the upper and lower spacer segments each having opposed flat wrench-landing surfaces to facilitate connection and removal of the tool from the first and second sucker rod couplers.

12. The support tool of claim 11, wherein an outer sidewall of the lower narrow portion is tapered or chamfered to facilitate entrance of the lower narrow portion into the tubing string inlet or the upper extension thereof.

13. The support tool of claim 11, wherein the landing surface of the wide diameter portion meets the outer sidewall of the lower narrow portion of the tool at about a 90 degree angle.

14. The support tool of claim 11, wherein the one or more longitudinal slots comprises a plurality of longitudinal slots spanning the length of the wide portion and the narrow portion.

15. The support tool of claim 14, wherein the plurality of longitudinal slots is four longitudinal slots equi-spaced on the circumference of the wide portion.

16. A kit for use in a process for suspending operation of an oil or gas well, the kit comprising:

a) a tool as recited in claim 11; and b) instructions for coupling the tool to a sucker rod string and lowering the landing surface of the tool onto the tubing string inlet or the upper extension thereof.

17. The kit of claim 16, further comprising a combination of support tool retention elements, the combination comprising:

a) a hollow body adapter configured for attachment to the tubing string inlet or the upper extension thereof, to provide an upper surface for supporting the landing surface of the tool, and b) a hollow body tool protector configured for covering at least part of the upper portion of the tool, when landed on the top edge of the tubing string inlet or the upper extension thereof, and further configured for attachment to the adapter.

18. The kit of claim 17, wherein the kit further comprises a plurality of rod couplers for connecting the upper and lower threaded ends of the tool to rods.

19. The kit of claim 16, further comprising a combination of support tool retention elements, the combination comprising:

a) a hollow body tool protector configured for covering at least part of the upper portion of the tool, when landed on the top edge of the tubing string inlet or the upper extension thereof, and further configured for attachment to the adapter; and b) a hollow body adapter configured for attachment to the protector, the adapter configured for connection to an upper wellhead assembly.

* * * * *